US007267251B2

(12) United States Patent
Ophardt

(10) Patent No.: US 7,267,251 B2
(45) Date of Patent: Sep. 11, 2007

(54) DRAW BACK PUMP

(75) Inventor: Heiner Ophardt, Vineland (CA)

(73) Assignee: Hygiene-Technik Inc., Beamsville, Ontario (CA)

( * ) Notice: Subject to any disclaimer, the term of this patent is extended or adjusted under 35 U.S.C. 154(b) by 479 days.

(21) Appl. No.: 10/938,701

(22) Filed: Sep. 13, 2004

(65) Prior Publication Data

US 2005/0276707 A1 Dec. 15, 2005

(30) Foreign Application Priority Data

Jun. 9, 2004 (CA) ..... 2470532

(51) Int. Cl.
*B67D 5/06* (2006.01)

(52) U.S. Cl. ..... 222/321.9; 222/321.7; 222/181.1; 417/550

(58) Field of Classification Search ..... 222/321.1, 222/321.6–321.9, 383.1, 340, 181.1–181.3, 222/378, 385; 417/550
See application file for complete search history.

(56) References Cited

U.S. PATENT DOCUMENTS

| | | | |
|---|---|---|---|
| 4,781,312 | A | 11/1988 | Strazdins |
| 4,949,874 | A | 8/1990 | Fiedler |
| 4,991,747 | A | 2/1991 | Von Brocklin et al. |
| 5,339,990 | A | 8/1994 | Wilder |
| 5,458,289 | A | 10/1995 | Cater et al. |
| 5,676,277 | A | 10/1997 | Ophardt |
| 5,836,482 | A | 11/1998 | Ophardt et al. |
| 6,557,736 | B1 | 5/2003 | Ophardt |
| 6,601,736 | B2 | 8/2003 | Ophardt et al. |

FOREIGN PATENT DOCUMENTS

| | | |
|---|---|---|
| DE | 199 01 027 | 7/2000 |

*Primary Examiner*—J. Casimer Jacyna
(74) *Attorney, Agent, or Firm*—Riches, McKenzie & Herbert LLP

(57) ABSTRACT

A piston pump dispenser having a reciprocating piston pump arrangement which, in a dispensing stroke, dispenses fluid from an outlet and, in a charging stroke, to draw fluid from a reservoir also draws back fluid from the outlet through which fluid is dispensed in the dispensing stroke.

10 Claims, 5 Drawing Sheets

DRAW BACK PUMP

SCOPE OF THE INVENTION

Many dispensers of liquid such as hands soaps, creams, honey, ketchup and mustard and other viscous fluids which dispense fluid from a nozzle leave drop of liquid at the end of the outlet. This can be a problem that the liquid may harden, as creating an obstruction which reduces the area for fluid flow in future dispensing. The obstruction can result in future dispensing through a small area orifice resulting in spraying in various directions such as onto a wall or user to stain the wall or user or more disadvantageously into the eyes of a user.

Many dispensers of material such as creams and for example liquid honey have the problem of stringing in which an elongate string of fluid hangs from fluid in the outlet and dangles from the outlet after dispensing an allotment of fluid. With passage of time the string may form into a droplet and drop from the outlet giving the appearance that the dispenser is leaking.

Piston pumps as for soap dispensers are known as taught in U.S. Pat. No. 5,676,277 to Ophardt issued Oct. 14, 1997 which is incorporated herein by reference.

SUMMARY OF THE INVENTION

To at least partially overcome these disadvantages of previously known devices the present invention provides a piston pump dispenser having a reciprocating piston pump arrangement which in a dispensing stroke dispenses fluid from an outlet and in a charging stroke to draw fluid from a reservoir also draws back fluid from the outlet through which fluid is dispensed in the dispensing stroke.

The present invention is particularly applicable to fluid dispensers which fluid is to be dispensed out of an outlet with the outlet forming an open end of a tubular member. In many applications, the tubular member has its outlet opening downwardly and fluid passing through the tubular member is drawn downwardly by the forces of gravity.

An object of the present invention is to provide a fluid dispenser in which after dispensing fluid out an outlet draws fluid back through the outlet to reduce dripping and/or stringing.

An object of the present invention is to provide a simplified piston pump for dispensing fluid and after dispensing draws back fluid from the outlet of a nozzle from which the fluid has been dispensed.

Accordingly, in one aspect the present invention provides a pump for a fluid dispenser, the pump comprising a first piston pump and a second piston pump, the first piston pump having a first chamber and a first piston reciprocally slidable in the first chamber between an extended and a retracted position, the first chamber having an inlet adapted for communication with a reservoir of fluid, the first chamber having an exit in communication with an outlet passageway having an outlet from which fluid is to be dispensed, a one-way inlet valve permitting fluid flow into the first chamber from the reservoir via the inlet but preventing fluid flow outwardly from the first chamber through the inlet;

a one-way outlet valve permitting fluid flow to the outlet passageway from the first chamber via the exit but preventing fluid flow through the one-way outlet valve from the outlet passageway into the first chamber via the exit, the second pump having a second chamber and a second piston reciprocally slidable in the second chamber for movement between an extended position and a retracted position, a communication port opening into the second chamber in communication with the outlet passageway downstream of the one-way outlet valve, a coupling mechanism coupling the first piston and the second piston for movement in unison such that when the first piston pump dispenses fluid from the first chamber to the outlet passageway via the exit, the second piston pump dispenses fluid from the second chamber to the outlet passageway and when the first piston pump draws fluid into the first chamber past the one-way inlet valve, the second piston pump draws fluid through its communication port from the outlet passageway into the second chamber.

In another aspect the present invention provides a pump for dispensing liquids from a reservoir, comprising:

a piston-chamber forming member having a cylindrical inner chamber and a cylindrical outer chamber, the inner chamber and outer chamber each having a diameter, a chamber wall, an inner end and an outer end, the inner end of the inner chamber in fluid communication with a reservoir, the diameter of the inner chamber being less than the diameter of the outer chamber, the inner chamber and outer chamber being coaxial with the outer end of the inner chamber opening into the inner end of the outer chamber, a one-way valve between the reservoir and the inner chamber permitting fluid flow through the inner end of said inner chamber only from the reservoir to the inner chamber;

a piston forming element received in the piston-chamber forming member axially slidable inwardly and outwardly therein, said piston forming element being generally circular in cross-section with a central axially extending hollow stem having a outlet passageway closed at an inner end and having an outlet proximate an outer end, a circular flexing disc extending radially outwardly from the stem proximate an inner end of the stem, the flexing disc having an elastically deformable edge portion proximate the chamber wall of the inner chamber circumferentially thereabout, a circular sealing disc extending radially outwardly from the stem spaced axially outwardly from the flexing disc, the sealing disc engaging the chamber wall of the outer chamber circumferentially thereabout to form a substantially fluid impermeable seal therewith on sliding of said piston forming element inwardly and outwardly, an inlet located on the stem between the flexing disc and sealing disc in communication with the outlet passageway, the piston forming element slidably received in the piston-chamber forming member for reciprocal axial inward and outward movement therein with the flexing disc in the inner chamber and sealing disc in the outer chamber, the flexing disc substantially preventing fluid flow in the inner chamber past the flexing disc in an inward direction, the flexing disc elastically deforming away from the chamber wall of the inner chamber to permit fluid flow in the inner chamber past the flexing disc outwardly.

In a further aspect the present invention provides a pump for dispensing liquid from a reservoir comprising:

a piston-chamber forming member having a cylindrical inner chamber, a cylindrical intermediate chamber and a cylindrical outer chamber, the inner chamber, intermediate chamber and outer chamber each having a diameter, a chamber wall, an inner end and an outer end;

wherein either:

(a) the diameter of the inner chamber being less than the diameter of the intermediate chamber, and the diameter of the intermediate chamber being less than the diameter of the outer chamber, or (b) the diameter of the inner chamber being greater than the diameter of the intermediate chamber, and the diameter of the intermediate chamber being greater than the diameter of the outer chamber, the inner chamber, intermediate chamber and outer chamber being coaxial with the outer end of the inner chamber opening into the inner end of the intermediate chamber and the outer end of the intermediate chamber opening into the inner end of the outer chamber;

the inner end of the inner chamber in fluid communication with a reservoir, a piston forming element received in the piston-chamber forming member axially slidable inwardly and outwardly therein, said piston forming element being generally circular in cross-section with a central axially extending hollow stem having a central outlet passageway closed at an inner end and having an outlet proximate an outer end, a circular inner flexing disc extending radially outwardly from the stem proximate an inner end of the stem, the inner flexing disc having an elastically deformable edge portion proximate the chamber wall of the inner chamber circumferentially thereabout, a circular intermediate flexing disc extending radially outwardly from the stem spaced axially outwardly from the inner flexing disc, the intermediate flexing disc having an elastically deformable edge portion proximate the chamber wall of the intermediate chamber circumferentially thereabout, a circular sealing disc extending radially outwardly from the stem spaced axially outwardly from the intermediate flexing disc, the sealing disc engaging the chamber wall of the outer chamber circumferentially thereabout to form a substantially fluid impermeable seal therewith on sliding of said piston forming element inwardly and outwardly, an inlet located on the stem between the intermediate flexing disc and the sealing disc in communication with the outlet passageway, the piston forming element slidably received in the piston chamber forming member for reciprocal axial inward and outward movement therein with the inner flexing disc in the inner chamber, the intermediate flexing disc in the intermediate chamber and the sealing disc in the outer chamber, the inner flexing disc substantially preventing fluid flow in the inner chamber past the inner flexing disc in an inward direction, the intermediate flexing disc substantially preventing fluid flow in the intermediate chamber past the intermediate flexing disc in an inward direction, the inner flexing disc elastically deforming away from the chamber wall of the inner chamber to permit fluid flow in the inner chamber past the inner flexing disc in an outward direction, the intermediate flexing disc elastically deforming away from the chamber wall of the intermediate chamber to permit fluid flow in the intermediate chamber past the intermediate flexing disc in an outward direction.

DETAILED DESCRIPTION OF THE DRAWINGS

Figure 1:
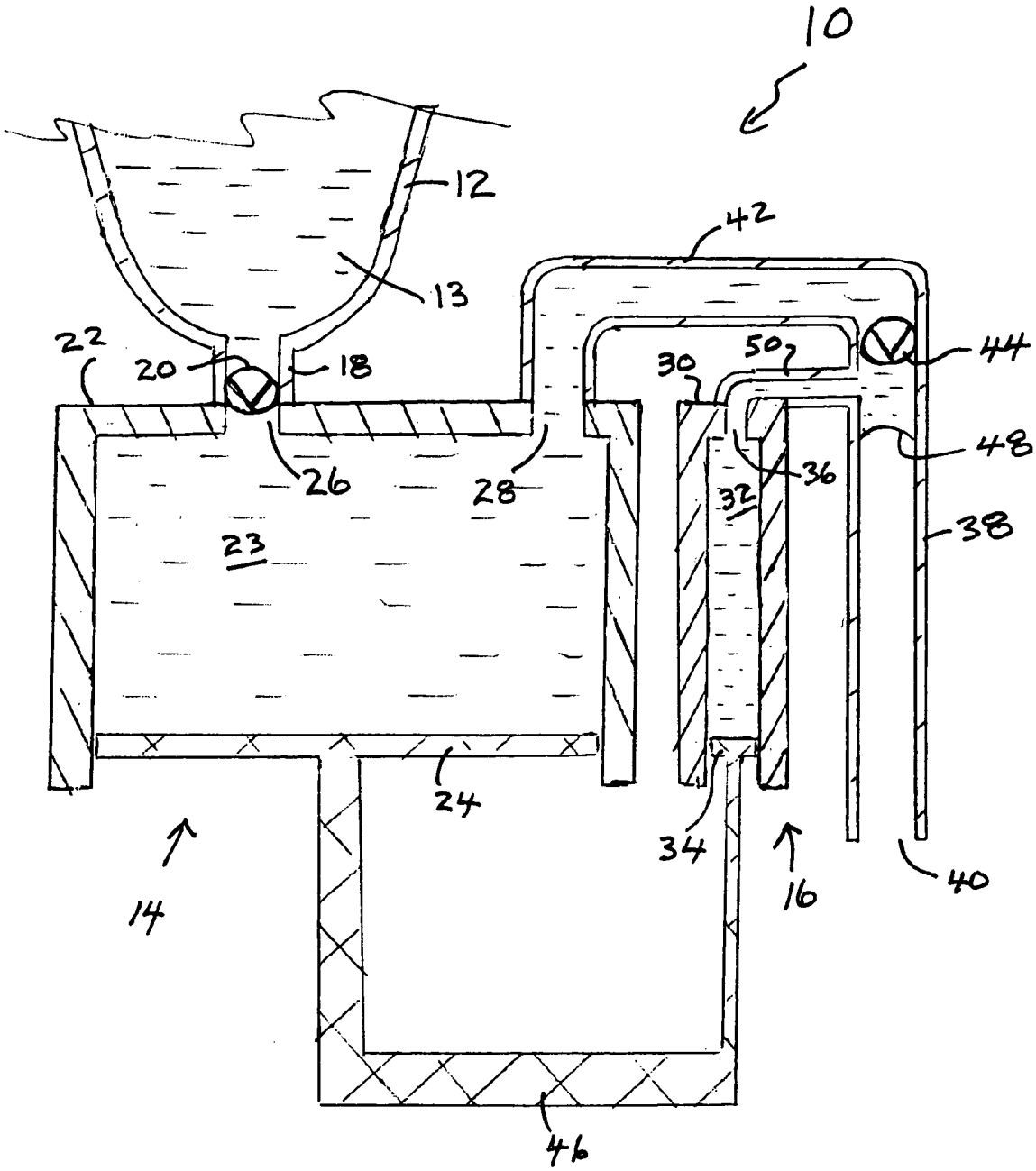
FIG. 1 is a schematic cross-sectional side view of a pump in accordance with a first embodiment of the present invention is a fully extended position.
Figure 2:
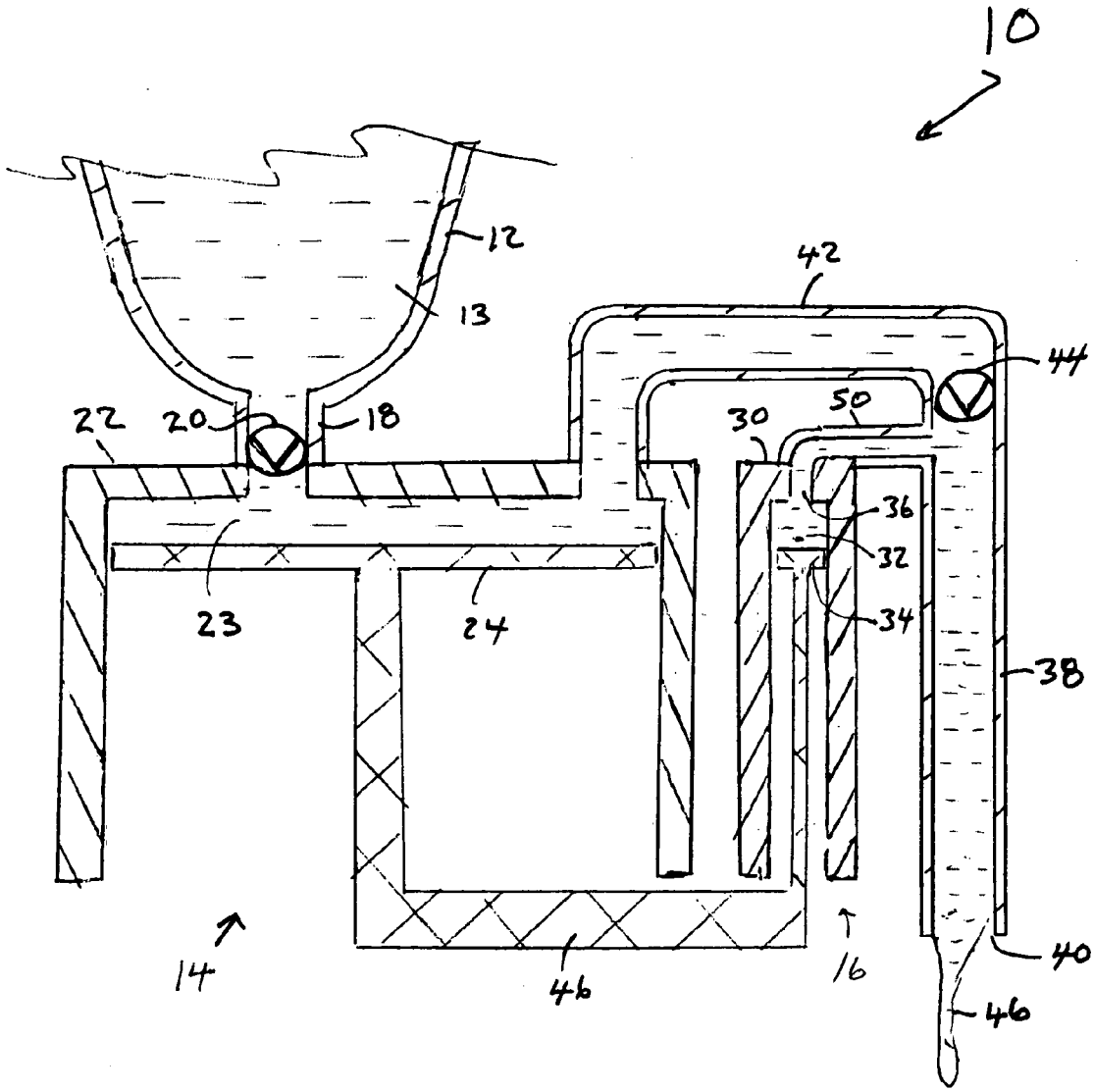
FIG. 2 is a view identical to that in FIG. 1 but in a retracted position.

Reference is made first to FIGS. 1 and 2 which schematically illustrates a first embodiment of a dispenser 10 which in accordance with a first embodiment of the present invention.

The dispenser 10 comprises a reservoir 12 for fluid 13 to be dispensed, a first piston pump 14 and a second piston pump 16. The first piston pump 14 has a piston chamber-forming member 22 forming a first chamber 23 within which a first piston 24 is coaxially slidable. The piston chamber-forming member 22 has an inlet opening 26 and an outlet opening 28.

A feed conduit 18 connects the reservoir 12 to the inlet opening 26 of the first piston pump 14. A one-way inlet valve 20 in the conduit 18 merely permits fluid flow through the conduit 18 from the reservoir 12 to the first chamber 23.

The second piston pump 16 has a piston chamber-forming member 30 forming a second chamber 32 within which a second piston 34 is coaxially slidable. The piston chamber-forming member 30 has a communication opening 36.

An outlet tube 38 is provided with an outlet 40 from which fluid is to be dispensed.

The first pump outlet opening 28 is connected via an exit conduit 42 with the outlet tube 38. A one-way outlet valve 44 is provided which merely permits fluid flow through the exit conduit 42 from the first chamber 23 to the outlet tube 38.

A communication conduit 50 extends from the communication opening 36 of the second chamber 32 to connect to the outlet tube 38 downstream from the one-way outlet valve 44.

The first piston 24 and the second piston 34 are mechanically coupled via splint 46 for sliding in unison relative their respective piston chamber-forming members in reciprocal motion between the extended position shown in FIG. 1 and the retracted position shown in FIG. 2. In moving from the retracted position to the extended position in a charging stroke, fluid is drawn from the reservoir 12 into the first chamber 23 with the suction created in the first chamber 23 drawing fluid past the one-way inlet valve 20 and with the one-way outlet valve 44 preventing flow inwardly there through from the outlet tube 38. In this charging stroke, suction created within the second chamber 32 of the second piston pump 16 will draw fluid which is inside the outlet tube 38 downstream of the outlet valve 44 into the second chamber 32.

In moving from the extended position to the retracted position in a discharge stroke, fluid in the first chamber 23 is forced out of the first chamber 23 through the one-way outlet valve 44 into the outlet tube 38 and out the outlet 40. At the same time, any fluid which is in the second chamber 32 is forced out of the second chamber 32 and into the outlet tube 38.

FIG. 2 illustrates a condition after a completed discharge stroke and shows a globule, drop or string 46 of fluid extending downwardly and out of the outlet 40. On completion of the discharge stroke, preferably the pistons 24 and 34 are immediately moved toward the extended position as by a spring (not shown) which biases the pistons to the extended position.

As seen in FIG. 1, the fluid has been drawn back within the outlet tube 38 to a position that a meniscus 48 across the outlet tube 38 is withdrawn inside the outlet tube 38 inwardly from the outlet 40. This is advantageous in that in this position the fluid is less prone to drying or hardening. Moreover if there is any drying or hardening that leads to an obstruction, the obstruction will be internal within the outlet tube 38 and in subsequent dispensing if any fluid comes to be forced passed the obstruction, spraying will be prevented by reason of the obstruction being internal within the outlet tube 38 or at least any spraying can only occur in the same direction that the outlet tube is directed.

In a charging stroke, in the piston 34 of the second piston pump 16 moving from the retracted to the extended position, a volume of liquid will be drawn back so as to fill the second chamber 32. This volume preferably bears a relation to the volume of the outlet tube 32 from the outlet 40 back to a location where the meniscus 48 is desired to be formed and of course having regard to the volume of the outlet tube 38, the volume of any expected globule, drop or string 46, and the extent to which fluid in the outlet tube 38 and any expected globule, drop or string 46 of fluid as shown in FIG. 2 may be desired to be drawn back as well as the desired location of the meniscus 48.

If desired, the fluid may be drawn back such that the outlet tube 38 is substantially cleared of fluid and the meniscus 48 may come to be disposed within the communication conduit 50 or inside the second piston chamber 32 itself. If all fluid downstream of the one-way outlet valve 44 is drawn back into the second chamber 32 whose communication opening 36 is directed upwardly then there is no fluid which under gravity may drip out the outlet 40, as can be advantageous as, for example, with low viscosity flowable materials to be dispensed.

Since the second pump 16 is to discharge in a dispensing stroke, the same amount of material as it is to suck back during a charging stroke, the relative volume of the second chamber 32 may be selected without having particular regard to the volume of the fluid dispensed in a stroke by the first piston 14.

Figure 4:
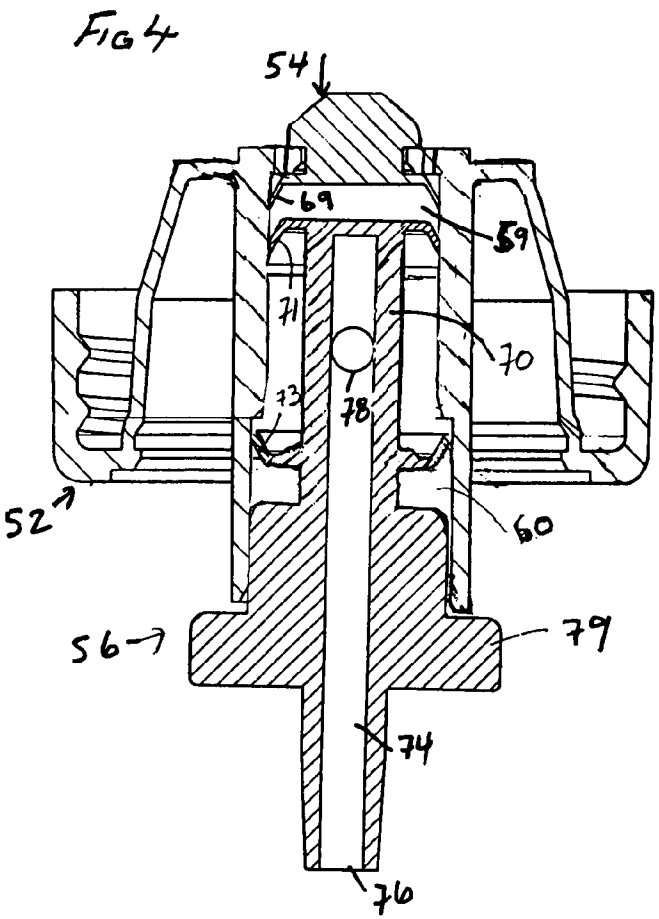
FIG. 4 is a view identical to that in FIG. 3 but in a retracted position.
Figure 3:
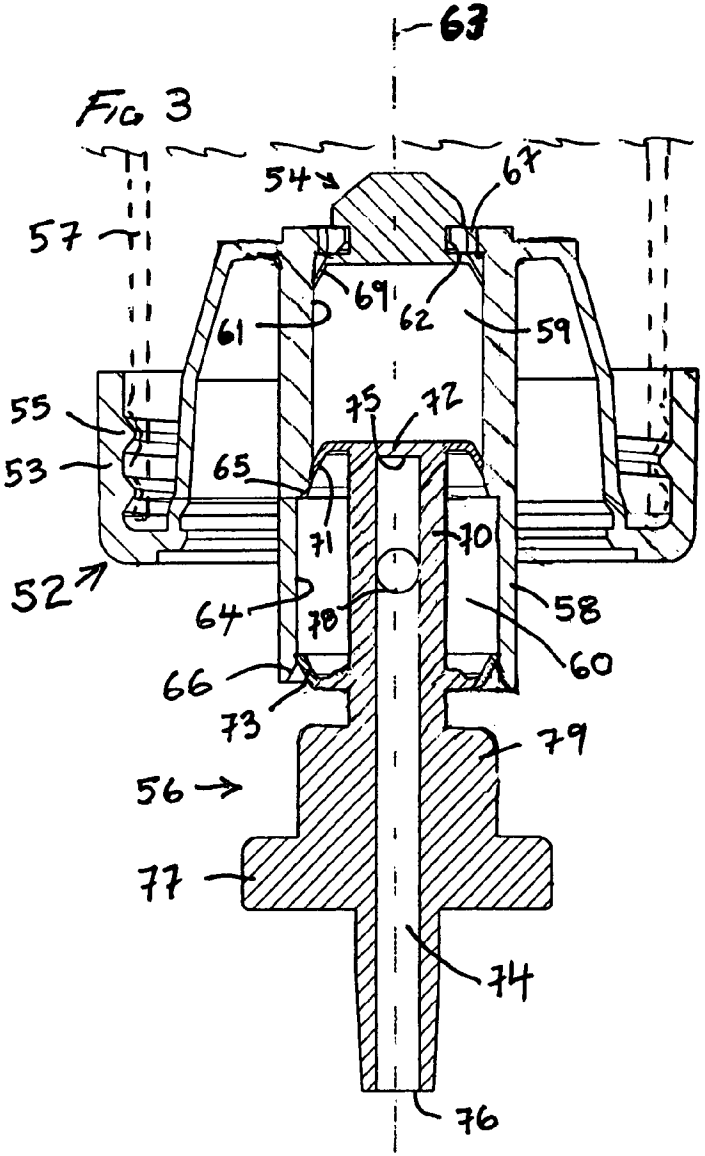
FIG. 3 is a schematic cross-sectional side view of a pump in accordance with a second embodiment of the present invention is a fully extended position.

Reference is made to FIGS. 3 and 4 which show a schematic second embodiment of a draw back dispensing pump assembly in accordance with the present invention.

The pump assembly comprises three principle elements, a piston chamber-forming body 52, a one-way inlet valve 54 and a piston 56. The body 52 carries an outer annular flange 53 with internal threads 55 which are adapted to engage threads of the neck of a bottle 57 shown in dashed lines only in FIG. 3 which is to form a fluid reservoir.

The body 52 includes an interior center tube 58 which provides a stepped cylindrical chamber having an inner cylindrical chamber 59 and an outer chamber 60. The outer chamber 60 is of a diameter greater than the diameter of the inner chamber 59. The inner chamber 59 has a cylindrical chamber wall 61, an inner end 62 and an outer end. The outer chamber 60 has a cylindrical chamber wall 64, an inner end 65 and an outer end 66. The inner and outer chambers are coaxially in the sense of being disposed about the same central axis 63. The outer and inner chambers are axially adjacent each other with the outer end of the inner chamber 59 opening into the inner end 65 of the outer chamber 60. Inlet openings 67 are provided in the inner end 62 of the inner chamber and the one-way valve 54 is disposed across the inlet openings 67. The inlet openings 67 provide communication with fluid in the bottle 57. The one-way valve 54 permits fluid flow from the bottle 57 into the chamber 59 but prevents fluid flow from the inner chamber 59 to the bottle.

The one-way valve 54 comprises a shouldered button which is secured in snap fit relation inside a central opening in the inner end 62 of the inner chamber with a circular resilient flexing disc 69 extending radially from the button. The flexing disc 69 is sized to circumferentially abut the chamber wall 61 of the inner chamber 59 substantially preventing fluid flow there past from the inner chamber 59 to the bottle 57. The flexing disc 69 is deflectable away from the wall 61 to permit flow from the bottle into the inner chamber 59.

The piston 56 is axially slidably received in the inner and outer chambers for reciprocal sliding motion inward and outwardly therein.

The piston 56 is generally circular in cross-section and is slidably received within the chambers. The piston preferably a unitary element formed entirely of plastic preferably by injection molding. The piston 56 has a hollow stem 70 extending along a central longitudinal axis 63 through the piston.

A circular resilient flexing disc 71 is located at an inner end 72 of the piston and extends radially therefrom. The flexing disc 71 is sized to circumferentially abut the chamber wall 61 of the inner chamber 59 substantially preventing fluid flow therebetween inwardly. The flexing disc 71 is biased radially outwardly however is adapted to be deflected radially inwardly so as to permit fluid flow past the flexing disc 71 as from the inner chamber 59 into the outer chamber 60.

An outer circular sealing disc 73 is located on the stem spaced axially outwardly from the flexing disc 71. The sealing disc 73 extends radially outwardly on the stem 70 to circumferentially engage the chamber wall 64 of the outer chamber 60 and to form a substantially fluid impermeable seal therebetween. Preferably the sealing disc 73 engages the chamber wall 64 of the outer chamber 60 to prevent flow there past both inwardly and outwardly.

The piston stem 70 has a hollow central outlet passageway 74 extending along the axis of the piston from a closed inner end 75 located in the stem between the flexing disc 71 and the sealing disc 73 to an outlet 76 at an outer end of the piston. A channel extends radially from an inlet 78 located on the side of the stem between the flexing disc 71 and the sealing disc 73 extending radially inwardly through the stem into communication with the central passageway 74. The channel and central passageway 74 permit fluid communication through the piston past the sealing disc 73 between the inlet 78 and the outlet 76.

An outer circular engagement flange 77 is provided on an outermost end portion of the stem which extends radially outwardly from the outer end 66 of the outer chamber 60. The flange 77 may be engaged by an actuating device (not shown) in order to move the piston 56 in and out of the body 52. Axially extending webs or ribs 79 may be provided to extend radially from the stem 70 to assist in maintaining the piston 56 in axially centred and aligned arrangement when sliding into and out of the chambers.

In moving from a retracted position as shown in FIG. 4 to an extended position of FIG. 3 in a charging stroke, suction is created in the inner chamber 59 in that the flexing disc 71 effectively acts as a one-way valve preventing flow inwardly there past such that movement of the piston 56 outwardly creates suction in the inner chamber 59 which draws fluid from the bottle past the inlet one-way valve 54. At the same time, a vacuum is formed in the outer chamber 60 to suck fluid within the outlet passageway 74 back into the outer chamber 60. Suction arises in the outer chamber 60 on the piston 54 moving outwardly in that the outer chamber 60 has a diameter larger than the diameter of the inner chamber 59 and thus with the piston 54 moving outwardly, the volume between the flexing disc 71 and the sealing disc 73 increases.

In a discharge stroke, when the piston 56 moves inwardly, fluid within the inner chamber 59 is compressed between the flexible disc 71 and the one-way inlet valve 54. The one-way inlet valve 54 effectively closes under pressure and as pressure is developed within the inner chamber 59, the flexible disc 71 deflects to permit fluid to pass downwardly past the flexible disc 71 to between the flexible disc 71 and the sealing disc 73 and hence via the inlet 78 to the outlet passageway 74 and out the outlet 76. With movement of the piston inwardly, the volume between the flexible disc 71 and the sealing disc 73 decreases which will also discharging fluid via the inlet 78 to the outlet passageway 74 and out the outlet 76.

The flexing disc 69 of the one-way valve 54 and the flexing disc 71 carried on the piston 56 each elastically deform away from the chamber wall 61 of the inner chamber 59 to prevent fluid flow in the inner chamber 59 past each disc outwardly.

Figure 6:
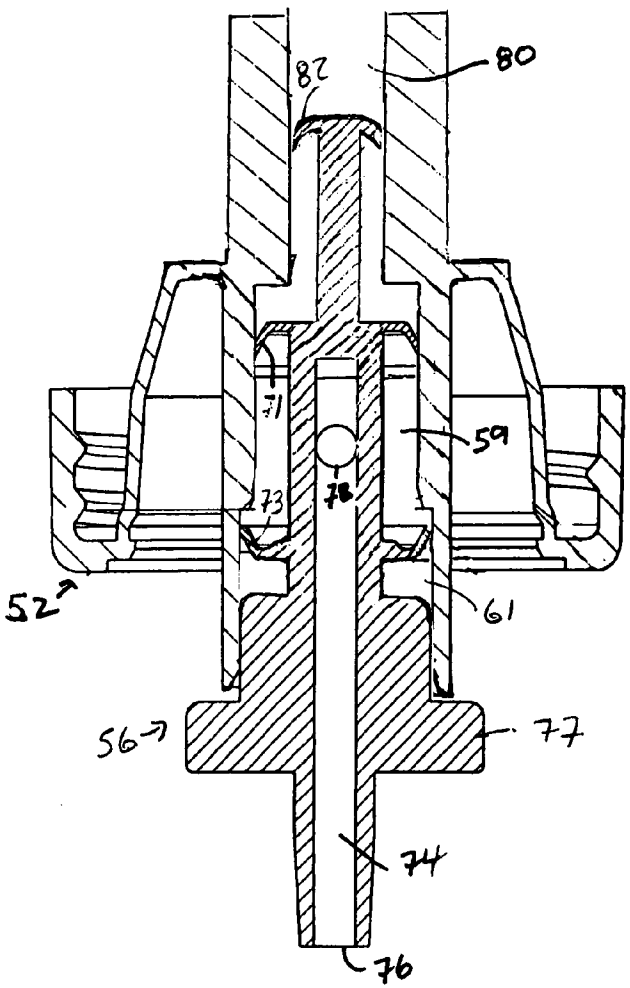
FIG. 6 is a view identical to that in FIG. 5 but in a retracted position.
Figure 5:
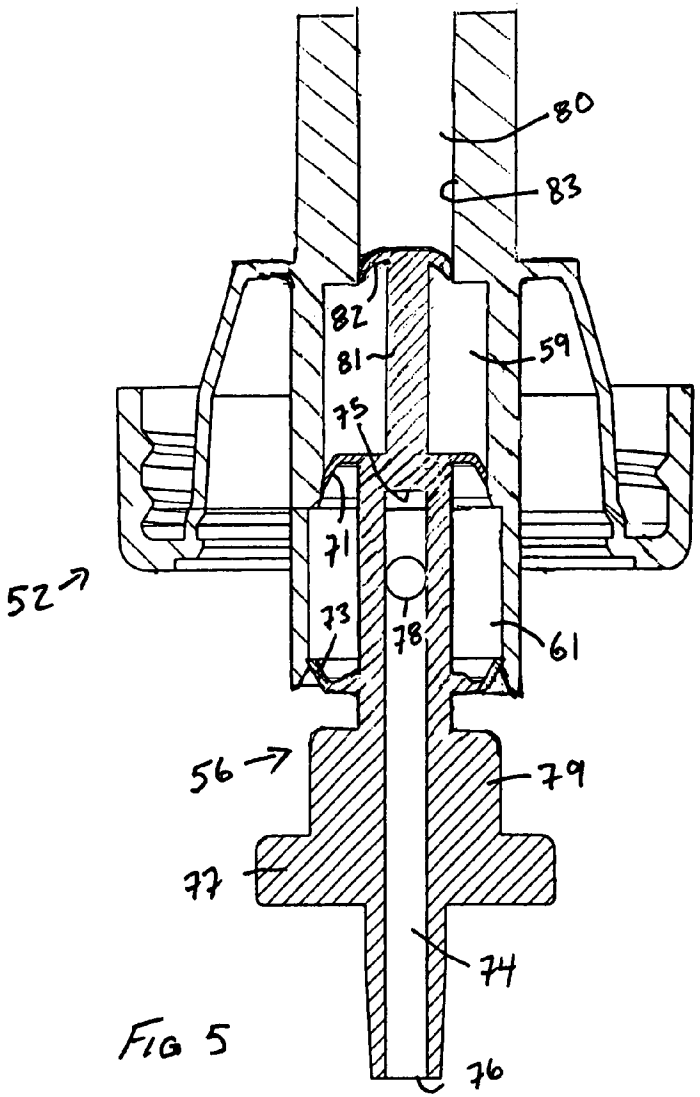
FIG. 5 is a schematic cross-sectional side view of a pump in accordance with a third embodiment of the present invention is a fully extended position.

Reference is made to FIGS. 5 and 6 which show a third embodiment of the invention in accordance with the present invention which is identical to the pump as shown in FIGS. 3 and 4 however the one-way valve 54 in FIGS. 5 and 6 has been replaced by providing an additional step to the chamber and providing an additional flexing disc on the piston. In FIGS. 5 and 6 similar reference numerals are used in FIGS. 5 and 6 to refer to similar elements in FIGS. 3 and 4.

In FIGS. 5 and 6 the piston chamber-forming body 52 has three coaxial chambers of different size namely an outer chamber 61, an intermediate chamber 59 and an inner chamber 80 each coaxially and each of a successively smaller diameter. The piston stem 70 carries an inner extension 81 on which there is provided an inner flexing disc 82 which extends radially outwardly from the stem 70 to proximate a chamber wall 83 of the inner chamber 80 circumferentially thereabout. The inner flexing disc 82 elastically deforms away from the chamber wall 83 of the inner chamber 80 to permit fluid flow in the inner chamber 80 past the inner flexing disc 82 outwardly. The inner flexing disc 82 substantially prevents fluid flow in the inner chamber 80 past the flexing disc 82 inwardly.

Operation of the embodiment of FIGS. 5 and 6 is substantially the same as that described with the reference to FIGS. 3 and 4 with a notable difference that with inward movement of the piston 56 from the extended position of FIG. 5 to the retracted position of FIG. 6, the volume between the inner flexible disc 82 and the intermediate flexible disc 71 decreases forcing fluid which cannot pass upwardly past the inner flexing disc 82 to exit past the intermediate flexing disc 71 downwardly. Similarly, in a charging stroke on the piston 56 moving from the retracted position of FIG. 6 to the extended position of FIG. 5 the volume between the inner flexing disc 82 and the intermediate flexing disc 71 increases thus drawing the fluid from the bottle past the inner flexing disc 82. In the charging stroke, as is the case with the other embodiments, fluid in the outlet passageway 74 is drawn back through the outlet passageway 74 into the space between the intermediate flexing disc 71 and the outer sealing disc 73 due to the reduction in volume between the intermediate flexing disc 71 and outer sealing disc 73.

Figure 7:
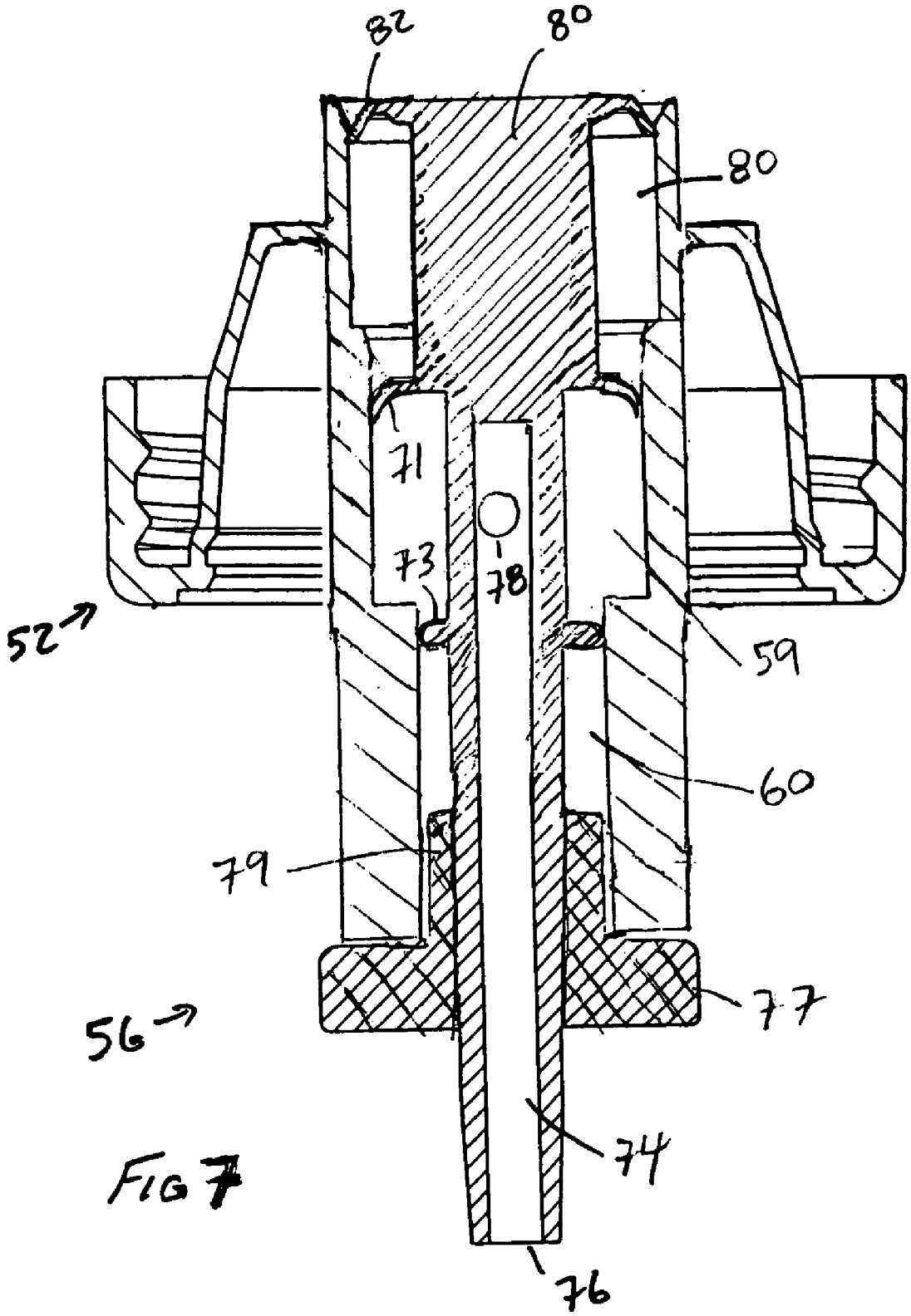
FIG. 7 is a schematic cross-sectional side view of a pump in accordance with a fourth embodiment of the present invention in a fully retracted position.

Reference is made to FIG. 7 which like the embodiment in FIGS. 5 and 6 also has a double stepped interior chamber with three chambers referred to as an inner chamber 80, an intermediate chamber 59 and an outer chamber 61. However in FIG. 7 the chambers decreases in radius from the outer chamber 60 to the intermediate chamber 59 to the inner chamber 80. In a discharge stroke the piston 54 is moved outwardly and in a charging stroke the piston 54 is moved inwardly. The inner flexible disc 82 and the intermediate flexible disc 71 effectively provide for one-way flow inwardly and the sealing disc 83 prevents fluid flow there past inwardly and outwardly. In a similar manner to that effectively described with reference 5 and 6, during a charging stroke when the piston is moving inwardly, the volume between the sealing disc 83 and the intermediate flexible disc 71 increases thus drawing fluid back into the intermediate chamber 59 from the outlet passageway 74.

In the embodiment of FIG. 7, the engagement flange 77 and the centering webs 79 are shown as a separate element to be fixedly secured to the remainder of the piston 54 to facilitate assembly.

In each of the embodiments, the channel inlet 78 through the stem 70 to the outlet passageway 74 shown as being disposed as a radially extending through a tubular wall of the stem 70 between the flexible disc 71 and the sealing disc 73. The communication into the outlet passageway 74 need be merely between the flexible discs 71 and the sealing disc 73 on the piston and could for example be provided to extend into the sealing disc 73 and then through the sealing disc into the outlet passageway.

The dispensing pump illustrated in the Figures may in a known manner be adapted for use with a collapsible reservoir or with a rigid non-collapsible reservoir. When used with a rigid non-collapsible reservoir then some mechanism may be provided to vent air into the reservoir in a known manner.

The pump may be provided with suitable activating mechanism such as known levers and the like to movement of the piston in one direction with a biasing mechanism such as springs and the like to return the piston. Manually operated or mechanical activators may be used.

While the invention has been described with reference to preferred embodiments many variations and modifications will now occur to persons skilled in the art. For a definition of the invention reference is made to the appended claims.

I claim:

1. A pump for dispensing liquids from a reservoir, comprising:

a piston-chamber forming member having a cylindrical inner chamber and a cylindrical outer chamber, the inner chamber and outer chamber each having a diameter, a chamber wall, an inner end and an outer end, the inner end of the inner chamber in fluid communication with a reservoir, the diameter of the inner chamber being less than the diameter of the outer chamber, the inner chamber and outer chamber being coaxial with the outer end of the inner chamber opening into the inner end of the outer chamber, a one-way valve between the reservoir and the inner chamber permitting fluid flow through the inner end of said inner chamber only from the reservoir to the inner chamber;

a piston forming element received in the piston-chamber forming member axially slidable inwardly and outwardly therein, said piston forming element being generally circular in cross-section with a central axially extending hollow stem having a outlet passageway closed at an inner end and having an outlet proximate an outer end, a circular flexing disc extending radially outwardly from the stem proximate an inner end of the stem, the flexing disc having an elastically deformable edge portion proximate the chamber wall of the inner chamber circumferentially thereabout, a circular sealing disc extending radially outwardly from the stem spaced axially outwardly from the flexing disc, the sealing disc engaging the chamber wall of the outer chamber circumferentially thereabout to form a substantially fluid impermeable seal therewith on sliding of said piston forming element inwardly and outwardly, an inlet located on the stem between the flexing disc and sealing disc in communication with the outlet passageway, the piston forming element slidably received in the piston-chamber forming member for reciprocal axial inward and outward movement therein with the flexing disc in the inner chamber and sealing disc in the outer chamber, the flexing disc substantially preventing fluid flow in the inner chamber past the flexing disc in an inward direction, the flexing disc elastically deforming away from the chamber wall of the inner chamber to permit fluid flow in the inner chamber past the flexing disc outwardly.

2. A pump as claimed in claim 1 including an engagement flange on said stem outward of the piston chamber forming member for engagement to move the piston forming element inwardly and outwardly.

3. A pump as claimed in claim 2 wherein:

said piston forming element extends outwardly from the outer end of the outer chamber, and an engagement flange is provided on the piston forming element outward of the piston-chamber forming member for engagement to move the piston forming element inwardly and outwardly.

4. A pump as claimed in claim 3 wherein:

the engagement flange comprises a circular flange extending radially outwardly from said stem.

5. A pump as claimed in claim 2 including a plurality of axially extending webs on said stem extending radially outwardly from the stem to engage the chamber wall of at least one of the inner chamber, intermediate chamber and outer chamber and guide the piston forming element in sliding axially centred alignment within the outer chamber.

6. A pump as claimed in claim 2 wherein the piston forming element consists of a unitary element formed entirely of plastic by injection molding.

7. A pump as claimed in claim 2 wherein the piston chamber forming member having a cylindrical inlet chamber, the inlet chamber having a diameter, a chamber wall, an inner end and an outer end;

the diameter of the inlet chamber being less than the diameter of the inner chamber, the inlet chamber being coaxial with the inner chamber with the outer end of the inlet chamber opening into the inner end of the inner chamber, the inner end of the inlet chamber in fluid communication with the reservoir, the piston forming element including a circular inlet flexing disc extending radially outwardly from the stem spaced axially inwardly from the inner flexing disc, the inlet flexing disc having an elastically deformable edge portion proximate the chamber wall of the inlet chamber circumferentially thereabout, when the piston forming element is slidably received in the piston chamber forming member for reciprocal axial inward and outward movement therein with the inner flexing disc in the inner chamber, and the sealing disc in the outer chamber, the one-way valve is provided by the inlet flexing disc being received in the inlet chamber;

the inner flexing disc substantially preventing fluid flow in the inlet chamber past the inlet flexing disc in an axial direction, the inlet flexing disc elastically deforming away from the chamber wall of the inlet chamber to permit fluid flow in the inlet chamber past the inlet flexing disc in an outward direction.

8. A pump for dispensing liquid from a reservoir comprising:

a piston-chamber forming member having a cylindrical inner chamber, a cylindrical intermediate chamber and a cylindrical outer chamber, the inner chamber, intermediate chamber and outer chamber each having a diameter, a chamber wall, an inner end and an outer end;

wherein either:

(a) the diameter of the inner chamber being less than the diameter of the intermediate chamber, and the diameter of the intermediate chamber being less than the diameter of the outer chamber, or (b) the diameter of the inner chamber being greater than the diameter of the intermediate chamber, and the diameter of the intermediate chamber being greater than the diameter of the outer chamber, the inner chamber, intermediate chamber and outer chamber being coaxial with the outer end of the inner chamber opening into the inner end of the intermediate chamber and the outer end of the intermediate chamber opening into the inner end of the outer chamber;

the inner end of the inner chamber in fluid communication with a reservoir, a piston forming element received in the piston-chamber forming member axially slidable inwardly and outwardly therein, said piston forming element being generally circular in cross-section with a central axially extending hollow stem having a central outlet passageway closed at an inner end and having an outlet proximate an outer end, a circular inner flexing disc extending radially outwardly from the stem proximate an inner end of the stem, the inner flexing disc having an elastically deformable edge portion proximate the chamber wall of the inner chamber circumferentially thereabout, a circular intermediate flexing disc extending radially outwardly from the stem spaced axially outwardly from the inner flexing disc, the intermediate flexing disc having an elastically deformable edge portion proximate the chamber wall of the intermediate chamber circumferentially thereabout, a circular sealing disc extending radially outwardly from the stem spaced axially outwardly from the intermediate flexing disc, the sealing disc engaging the chamber wall of the outer chamber circumferentially thereabout to form a substantially fluid impermeable seal therewith on sliding of said piston forming element inwardly and outwardly, an inlet located on the stem between the intermediate flexing disc and the sealing disc in communication with the outlet passageway, the piston forming element slidably received in the piston chamber forming member for reciprocal axial inward and outward movement therein with the inner flexing disc in the inner chamber, the intermediate flexing disc in the intermediate chamber and the sealing disc in the outer chamber, the inner flexing disc substantially preventing fluid flow in the inner chamber past the inner flexing disc in an inward direction, the intermediate flexing disc substantially preventing fluid flow in the intermediate chamber past the intermediate flexing disc in an inward direction, the inner flexing disc elastically deforming away from the chamber wall of the inner chamber to permit fluid flow in the inner chamber past the inner flexing disc in an outward direction, the intermediate flexing disc elastically deforming away from the chamber wall of the intermediate chamber to permit fluid flow in the intermediate chamber past the intermediate flexing disc in an outward direction.

9. A pump as claimed in claim 8 wherein the diameter of the inner chamber is less than the diameter of the intermediate chamber and the diameter of the intermediate chamber is less than the diameter of the outer chamber.

10. A pump as claimed in claim 8 wherein the diameter of the inner chamber is greater than the diameter of the intermediate chamber and the diameter of the intermediate chamber is greater than the diameter of the outer chamber.

* * * * *